United States Patent [19]

Benson

[11] Patent Number: 4,831,416

[45] Date of Patent: May 16, 1989

[54] SHEET SET ADVANCING APPARATUS

[75] Inventor: Marshall Benson, Fairport, N.Y.

[73] Assignee: Xerox Corporation, Stamford, Conn.

[21] Appl. No.: 158,445

[22] Filed: Feb. 22, 1988

[51] Int. Cl.[4] ..... G03G 15/00

[52] U.S. Cl. ..... 355/309; 198/624; 271/272

[58] Field of Search ..... 355/3 SH, 14 SH; 271/314, 272–274, 10; 198/422, 624; 270/53

[56] References Cited

U.S. PATENT DOCUMENTS 3,719,266 3/1973 Korn et al. ..... 198/624 X 3,788,638 1/1974 Lehmann ..... 271/272 X 3,894,732 7/1975 Müller ..... 271/10

FOREIGN PATENT DOCUMENTS 61-243739 10/1986 Japan ..... 271/272

*Primary Examiner*—A. T. Grimley

*Assistant Examiner*—J. Pendegrass

*Attorney, Agent, or Firm*—H. Fleischer; J. E. Beck; R. Zibelli

[57] ABSTRACT

An apparatus in which a rotatably mounted roller cooperates with a rotatably mounted polyhedron to define a nip through which a set of sheets is advanced.

2 Claims, 3 Drawing Sheets

SHEET SET ADVANCING APPARATUS

This invention relates generally to an electrophotographic printing machine, and more particularly concerns an apparatus for feeding sets of copy sheets.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing systems of the foregoing type, the copy sheets with the information permanently affixed thereto, are transported to a finishing station. The copy sheets are compiled at the finishing station. After the requisite number of sheets have been compiled, corresponding to a set of original documents, the copies of the set may be permanently affixed to one another to form a booklet thereof. Most frequently, a stapling apparatus is employed to secure the sheets of the set to one another to form the booklet. Alternatively, the sheets of the set may remain unsecured to one another. In either event, the set of copy sheets is advanced from the compiling tray to the output tray where the operator removes the set of sheets from the printing machine. Transport rolls are frequently used to advance the set of sheets from the compiler tray to the output tray. The transport rolls are required to conform to the stack height of the set of copy sheets being advanced. In this way, the transport rolls exert pressure on the set of copy sheets to continually move the set of copy sheets. Hereinbefore, the transport rolls were generally round rolls made from foam. These rolls compressed sufficiently to advance sets of copy sheets having from one to fifty sheets of twenty pound paper. Other systems used substantially rigid transport rolls mounted on shafts which were spring mounted so as to resiliently urge the roll against the set of copy sheets with the required normal force to insure advancement of the set.

In accordance with one aspect of the present invention, there is provided an apparatus for advancing a set of sheets. The apparatus includes a rotatably mounted roller and a rotatably mounted polyhedron member. The polyhedron member cooperates with the roller to define a nip through which the set of sheets is advanced.

Pursuant to another aspect of the features of the present invention, there is provided an electrophotographic printing machine of the type in which successive copy sheets having indicia recorded thereon are compiled into sets and the sets of sheets are advanced. The improvement for advancing the sets of sheets includes a rotatably mounted roller and a rotatably mounted polyhedron member. The polyhedron member cooperates with the roller to define a nip through which the set of sheets is advanced.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
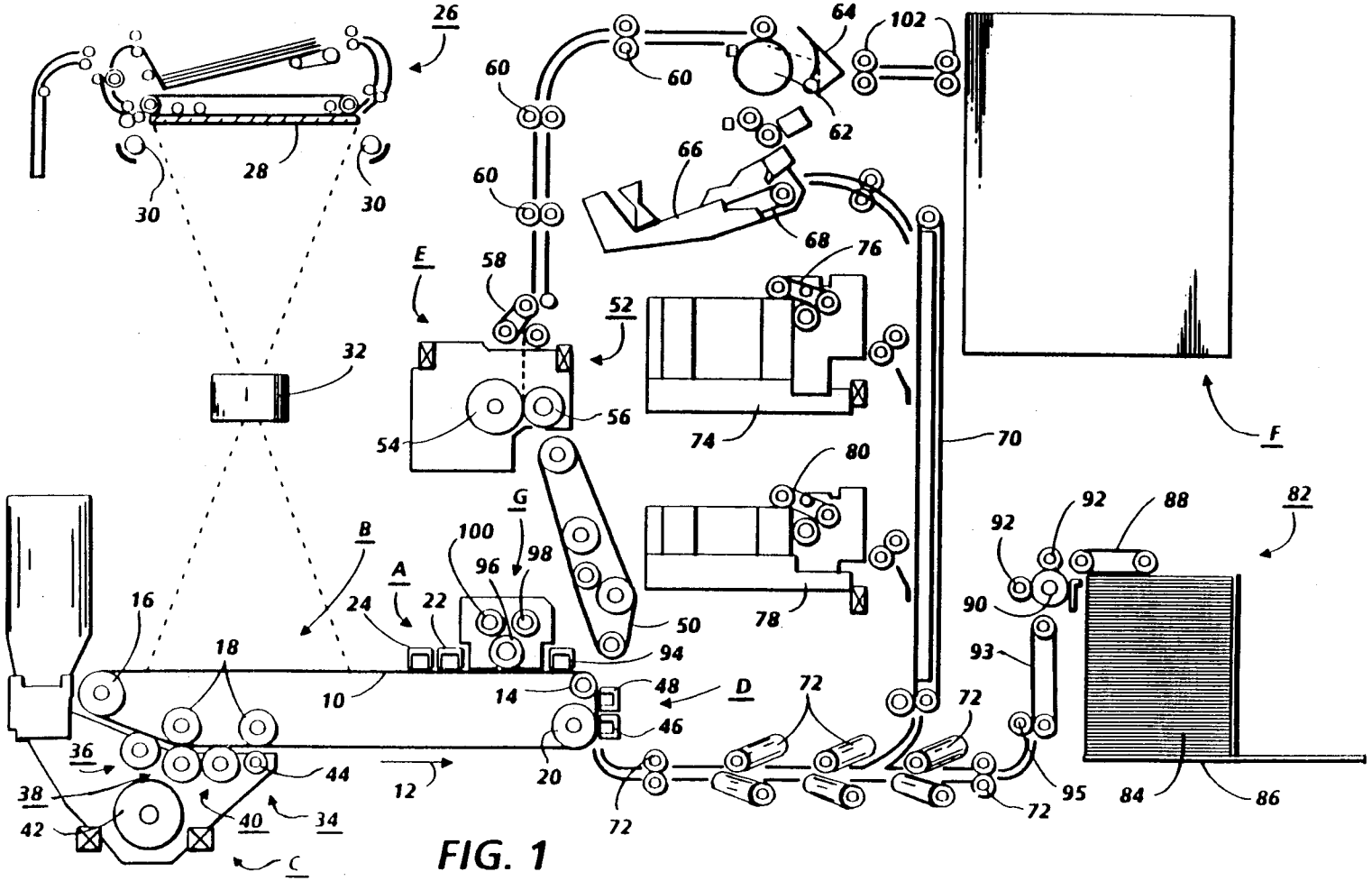
FIG. 1 is a schematic elevational view depicting an illustrative electrophotographic printing machine incorporating the sheet set advancing apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet set advancing apparatus of the present invention may be employed in a wide variety of devices and is not specifically limited in its application to the particular embodiment depicted herein.

Referring initially to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generator layer is made from trigonal selenium. The ground layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means, such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up in the document tray on top of the document handling unit. A document feeder located below the tray forwards the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the documents are transmitted through lens 32. Lens 32 focuses light images of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10. Conveyor 50 advances the copy sheet to fusing station E.

Fusing station E includes a fuser assembly, indicated generally by the reference numeral 52 which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding rollers 60 then advance the sheet to duplex turn roll 62. Duplex solenoid gate 64 guides the sheet to the finishing station F or to duplex tray 66. At finishing station F, the copy sheets are compiled into a set on a compiler tray. The set of copy sheets may or may not be stapled. In either case, the set sheet advancing apparatus of the present invention advances the set of sheets to an output tray where the operator removes the completed set from the printing machine. Alternatively, duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70 and rollers 72 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. The secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to conveyor 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away drive roll 90 and idler rolls 92. The drive roll and idler rolls guide the sheet onto transport 93. Transport 93 and idler roll 95 advance the sheet to rolls 72 which, in turn, move the sheet to transfer station station D.

Invariably, after the copy sheet is separated from the photoconductive surface of belt 10, some residual particles remain adhering thereto. After transfer, photoconductive belt 10 passes beneath corona generating device 94 which charges the residual toner particles to the proper polarity. Thereafter, a precharge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
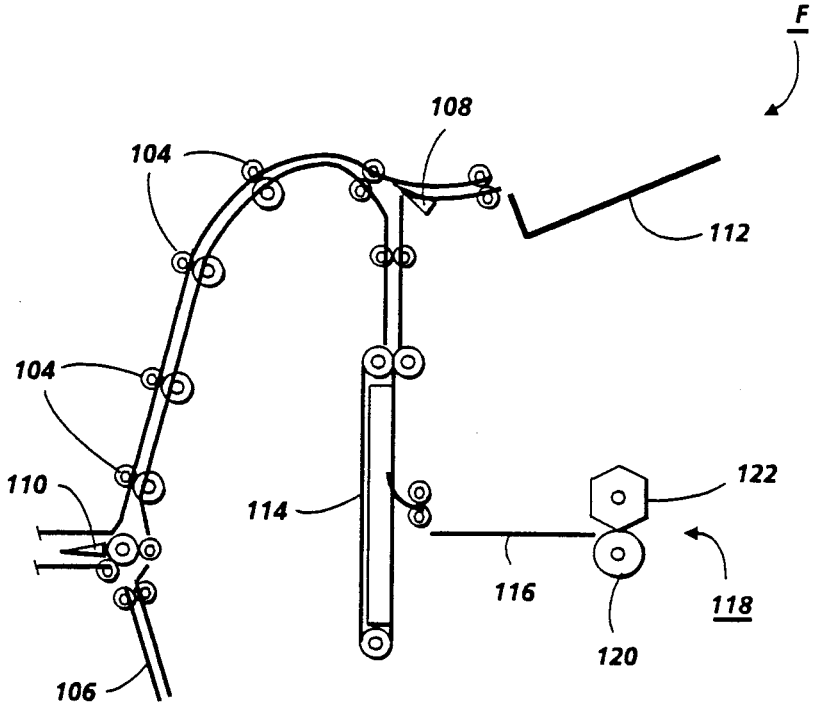
FIG. 2 is a schematic elevational view showing the finishing station of the FIG. 1 printing machine with the sheet set advancing apparatus.

Referring now to FIG. 2, the general operation of finishing station F will now be described. Finishing station F receives fused copies from rolls 102 (FIG. 1) and delivers them to solenoid actuated gate 110. Gate 110 diverts the copy sheet to either rolls 104 or inverter 106. A tri-roll nip is used to drive sheets into and out of the inverter. Inverter 106 has a compression spring which assists in reversing the direction of the sheets and assists in driving them out of the inverter. Inverter 106 is driven by a reversible AC motor. Two cross roll registration nips are used to register the sheets. The cross roll registration nips are driven by the sheet path drive motor. Rolls 104 advance the copy sheets to gate 108. Gate 108 diverts the sheets to either the top tray 112 or to vertical transport 114. Vertical transport 114 is a vacuum transport which transports sheets to compiler tray 116. Tray 116 used to compile and register sheets into sets. The set of sheet on tray 116 may be stapled or may remain unstapled. In either case, the sheet set advancing apparatus, indicated generally by the reference numeral 118, advances the stapled, or unfinished sets to a stacker where they are stacked for delivery to the operator. Sheet set advancing apparatus 118 has a drive roller 120 cooperating with a polyhedron member 122 to define a nip through which the set of sheets is advanced. A corrugated vacuum feeder may also be used to aid in the advancing of the set of copy sheets. Drive roller 120 is mounted rotatably and rotated by a motor. As roller 120 rotates, it rotates polyhedron 122. Rotation of roller 120 and polyhedron 122 advances the set of sheet from compiler tray 116 to the output stacker.

Figure 3:
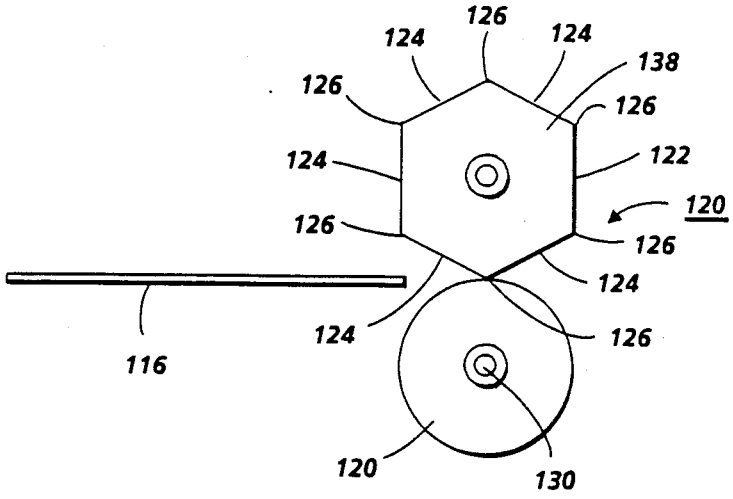
FIG. 3 is an enlarged, schematic elevational view further illustrating the FIG. 2 sheet set advancing apparatus.

Turning now to FIG. 3, there is shown further details of sheet set advancing apparatus 118. Preferably, polyhedron 122 is a six sided member made from six substantially rectangular planes 124 with each being of substantially equal area. The polyhedron has three sets of two planes which intersect one another to form six apexes 126. The six substantially rectangular planes 124 intersect opposed ends 138. Polyhedron 122 is positioned so that the apexes 126 contact roll 120. Preferably, polyhedron 122 is resilient being made from a compressible foam, such as a polyurethane material. While a polyhedron made from six substantially rectangular planes has been described, one skilled in the art will appreciate that a polyhedron having any suitable number of planes of equal or unequal area, rectangular or otherwise, may be employed. Polyhedron 122 is mounted on suitable bearings to rotate about shaft 128. As roller 120 rotates, it rotates polyhedron 122. Rotation of both polyhedron 122 and roller 120 advances the set of sheet from the compiler tray to the output stacker. Preferably, roller 120 is cylindrical and mounted on shaft 130 to rotate in unison therewith. Shaft 130 is mounted rotatably on suitable bearings to rotate in the frame of the finishing station. Preferably, roller 120 is substantially rigid being made from a hard rubber or any other suitable material. A motor 132 (FIG. 4) rotates roller 120.

Figure 4:
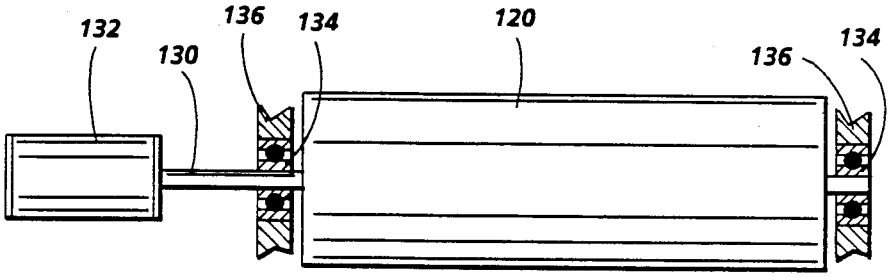
FIG. 4 is a schematic elevational view showing a motor driving the roller of the FIG. 3 sheet set advancing apparatus.

As shown in FIG. 4, Roller 120 is mounted on shaft 130. Shaft 130 is mounted on bearings 134 so as to rotate with respect to frame 136 of the finishing station. Motor 132 is connected to shaft 130. As motor 132 rotates shaft 130, roller 120 rotates in unison therewith.

In operation, roller 120 and polyhedron 122 define a nip through which the set of copy sheets is advanced. Polyhedron 122 compresses as it engages the set of copy sheets. The apexes of the polyhedron compress a distance proportional to the thickness of the set of copy sheets. Thus, the thicker the set of copy sheets, the greater the distance of compression. The normal force applied on the set of copy sheets is also proportional to the compression of the apex of the polyhedron. Since the frictional force advancing the set of copy sheets is proportional to the normal force, the greater the compression, the greater the frictional force for advancing the set of copy sheets. In this way, the force for advancing the set of copy sheets is directly proportional to the thickness of the set of copy sheets. A thin set of copy sheets produces a small amount of compression and a commensurate small force for advancing the set of copy sheets. In contra distinction, a thick set of copy sheets produces a large amount of compression and commensurate larger force for advancing the set of copy sheets. In this manner, the force developed to advance the set of copy sheets is proportional to the thickness of the set of copy sheets.

In recapitulation, the sheet set advancing apparatus has a roller cooperating with a polyhedron to define a nip through which a set of copy sheets is advanced. The roller rotates the polyhedron. As the set of sheets is advanced through the nip, the apex of the polyhedron compresses a distance proportional to the thickness of the set of copy sheets. In this way, the advancing force applied on the set of copy sheets is directly proportional to the thickness of the set of copy sheets.

It is, therefore, evident that there has been provided, in accordance with the present invention, a sheet set advancing apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for advancing a set of sheets having a plurality of sheets therein, including:

means for supporting the set;

a rotatably mounted substantially rigid roller operatively associated with said supporting means;

means for rotating said roller; and a rotatably mounted, substantially resilient polyhedron member cooperating with said roller to define a nip through which the set of sheets is advanced from said supporting means, said polyhedron member being rotated by said roller and comprising a plurality of intersecting planes so that said polyhedron member contacts said roller at the intersection of the planes thereof when the set of sheets is spaced therefrom and at least a portion of said polyhedron member compresses when the set of sheets passes through the nip.

2. An apparatus according to claim 1, wherein said polyhedron member includes six planes having substantially equal areas.

* * * * *